US007812612B2

(12) United States Patent
Feldtkeller et al.

(10) Patent No.: US 7,812,612 B2
(45) Date of Patent: Oct. 12, 2010

(54) METHOD AND APPARATUS FOR MONITORING THE OPERATION OF A GAS DISCHARGE LAMP

(75) Inventors: Martin Feldtkeller, Munich (DE); Michael Herfurth, Gilching (DE); Dieter Zipprick, Huellhorst (DE)

(73) Assignee: Infineon Technologies AG, Neubiberg (DE)

( * ) Notice: Subject to any disclaimer, the term of this patent is extended or adjusted under 35 U.S.C. 154(b) by 325 days.

(21) Appl. No.: 11/863,295

(22) Filed: Sep. 28, 2007

(65) Prior Publication Data

US 2008/0265900 A1 Oct. 30, 2008

(30) Foreign Application Priority Data

Sep. 28, 2006 (DE) ..... 10 2006 045 907

(51) Int. Cl.
*G01R 31/00* (2006.01)
*H05B 41/36* (2006.01)

(52) U.S. Cl. ..... 324/414; 315/291

(58) Field of Classification Search ..... 324/414, 324/403

See application file for complete search history.

(56) References Cited

U.S. PATENT DOCUMENTS

| | | | | |
|---|---|---|---|---|
| 5,859,505 | A * | 1/1999 | Bergman et al. | 315/307 |
| 6,140,771 | A * | 10/2000 | Luger et al. | 315/101 |
| 6,400,095 | B1 * | 6/2002 | Primisser et al. | 315/224 |
| 7,355,352 | B2 * | 4/2008 | Deppe et al. | 315/291 |
| 2008/0203939 | A1 * | 8/2008 | Pekarski et al. | 315/291 |

* cited by examiner

*Primary Examiner*—Hoai-An D Nguyen
(74) *Attorney, Agent, or Firm*—SpryIP, LLC

(57) ABSTRACT

For monitoring the operation of a gas discharge lamp operated with an AC voltage, a lamp voltage signal is generated which is dependent on the voltage dropped across the gas discharge lamp during operation. The lamp voltage signal is filtered with an attenuation that is different for a DC component and for a component having the frequency of the AC voltage, whereupon a positive and negative peak value of the filtered lamp voltage signal are determined. For monitoring the gas discharge lamp, an average value of the two peak values is determined and compared with a limit value, and a difference value between the two peak values is determined and compared with a limit value.

11 Claims, 4 Drawing Sheets

METHOD AND APPARATUS FOR MONITORING THE OPERATION OF A GAS DISCHARGE LAMP

RELATED APPLICATION

The present application claims priority to German Application No. 10 2006 045 907.5, filed 28 Sep. 2006, which is incorporated by reference herein in its entirety.

FIELD OF THE INVENTION

The present invention relates to an apparatus and a method for monitoring the operation of a gas discharge lamp.

BACKGROUND

In the case of gas discharge lamps such as fluorescent tubes, for example, AC current is conducted through a gas filling by means of two electrodes and thus excited to effect light emission. A voltage dropped across the gas discharge lamp during operation can increase on account of wear phenomena. This can take place uniformly in both current directions or else non-uniformly for both current directions, such that a rectifier effect occurs.

This increased voltage drop during the operation of the gas discharge lamp can lead to an increased power consumption and to greater heating of the gas discharge lamp. Particularly in the case of gas discharge lamps with a narrow glass bulb, that is at only a small distance from the electrodes, this excessive heating can lead to damage or else destruction of the gas discharge lamp.

It is an object to provide a method and also an apparatus for monitoring the operation of a gas discharge lamp by means of which a symmetrical and asymmetrical increase in the running voltage can be determined independently of one another in a simple manner.

This object is achieved according to the invention by means of a method having the features of Claim 1 and also an apparatus having the features of Claim 5. The subclaims describe in each case advantageous embodiments of the invention.

SUMMARY OF THE INVENTION

In one aspect of the present invention, the operation of a gas discharge lamp operated with AC voltage is monitored by a lamp voltage signal dependent on the running voltage dropped across the gas discharge lamp being obtained and filtered. In this case, an attenuation set for the DC component is different from that for a part having the frequency of the AC voltage with which the gas discharge lamp is operated. Furthermore, a positive and a negative peak value of the filtered lamp voltage signal are determined, an average value of the two peak values is formed and compared with a limit value, and a difference value between the two peak values is determined and compared with a limit value.

The evaluation of the average value of the two peak values makes it possible to obtain a measure of the DC component of the lamp voltage signal and hence of the running voltage of the gas discharge lamp and in this way to ascertain a rectifier effect, in the case of which the voltage drop across the gas discharge lamp is greater for current flow in one direction than in the other. The evaluation of the difference between the two peak values makes it possible to determine a symmetrical increase in the running voltage without the occurrence of a rectifier effect, which, however, can likewise lead to a higher evolution of heat and thus to damage of the discharge lamp.

BRIEF DESCRIPTION OF THE FIGURES

Embodiments of the invention are explained in more detail below with reference to the accompanying drawings, in which.

DETAILED DESCRIPTION

Figure 1:
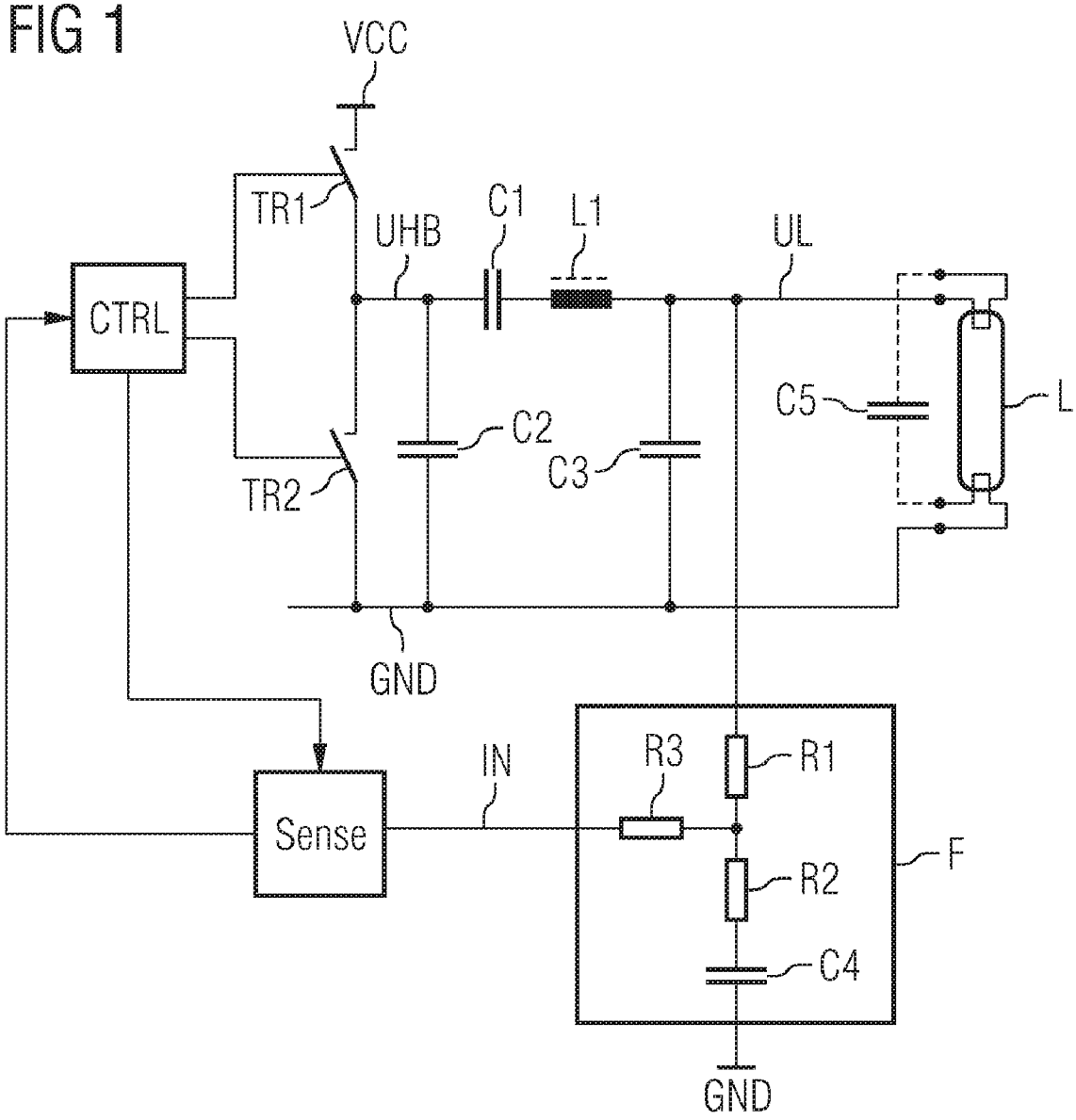
FIG. 1 shows a circuit arrangement for operating a fluorescent lamp with a device for monitoring the operation of the fluorescent lamp in accordance with a first exemplary embodiment.

FIG. 1 shows a circuit for operating a fluorescent lamp L by means of a DC voltage present on two current lines VCC and GND, the conductor GND representing the circuit ground. The fluorescent lamp L can be an arbitrary gas discharge lamp. ⅝ inch fluorescent lamps (T8) are widespread at the present time, and it is also possible to use fluorescent lamps having a ⅝ inch diameter (T5) with a higher efficiency. Particularly in the case of the T5 lamps, the distance between electrodes for supplying the operating current and the glass of the glass bulb is so small that, in the event of the electrodes being heated to an excessively great extent, the glass could melt with imminent danger of an accident. It is therefore desirable, when using these lamps, electronically to monitor the end of lifetime and in this regard a rise in the running voltage and, if appropriate to turn off the lamp.

In principle, a distinction is made between a symmetrical and an asymmetrical rise in the running voltage. The running voltage of a lamp also depends on the temperature and on the type of the lamp, such that a symmetrical rise in the running voltage does not necessarily indicate the end of lifetime. It can usually be assumed that the two electrodes of a lamp L do not wear uniformly, such that the emission capability of one electrode can decline first. The running voltage becomes asymmetrical in this case. An asymmetrical running voltage can occur in new lamps only shortly after turn-on, such that an asymmetrical running voltage lasting for a relatively long time clearly indicates the end of lifetime and generally damage or consumption of the lamp L. A relatively rapid rise in the symmetrical running voltage can indicate, for example, that the glass of the lamp L has been shattered. This case should also be identified in order to be able to protect the circuit arrangement for operating the lamp L.

The DC voltage present between the conductors VCC and GND can be approximately 400 volts, for example, and is present at a half-bridge formed by two transistors TR1 and TR2, wherein the transistor TR1 forms the high-side switch connected to VCC and the transistor TR2 connected to GND forms a low-side switch. The two transistors TR1, TR2 are used as switches and driven by a control unit CTRL. The two transistors TR1, TR2 can be MOSFET transistors, for example.

A half-bridge voltage UHB is present at the connecting node between the two transistors TR1 and TR2, the midpoint of the half-bridge TR1, TR2. The midpoint of the half-bridge TR1, TR2 is connected to one electrode of the lamp L via a DC blocking capacitor C1 for suppressing a DC current and an inductance L1. The other electrode of the lamp L is connected directly to ground GND. A resonance capacitor C3 is connected in parallel with the two electrodes of the lamp L. The half-bridge voltage UHB at the midpoint of the half-bridge TR1, TR2 is furthermore connected to ground GND via a capacitor C2, such that the edge steepness of the half-bridge voltage UHB can be set by said capacitor C2 and a trapezoidal voltage is present at the output of the half-bridge TR1, TR2.

The frequency of the half-bridge voltage is usually approximately 40 kHz. There is present at the lamp L an approximately sinusoidal running voltage UL having the same frequency, which can have a phase lag of usually 90° to 150° with respect to the half-bridge voltage UHB. On account of the DC blocking capacitor C1, the high-frequency AC current flowing through the lamp L contains no DC component. In the case of an intact lamp L, the running voltage UL across the lamp L also likewise has virtually no DC component.

The lamp voltage or running voltage UL across the lamp L is tapped off with the aid of a filter F and, after filtering in the filter F, is conducted to an input IN of a monitoring circuit SENSE. In the filter F, the lamp voltage UL is supplied to the monitoring circuit SENSE via a first resistor R1 and a third resistor R3 connected in series with the latter. The centre tap between the first resistor R1 and the third resistor R3 is connected to ground GND via a series circuit formed by a second resistor R2 and a filter capacitor C4. That terminal of the first resistor R1 which is connected to the lamp voltage UL thus forms the input of the filter F and that terminal of the third resistor R3 which is connected to the input IN of the monitoring circuit SENSE thus forms the output of the filter F. The transfer function of the filter F has essentially a single pole and a single zero on the real axis of a Laplace diagram, the zero lying to the right of the pole. DC signals of the lamp voltage UL can pass through the filter F without being attenuated. Higher-frequency components are conducted away to ground GND via the second resistor R2 and the filter capacitor C4 and thus attenuated.

In general, a voltage signal dependent on the running voltage of the fluorescent lamp L, i.e. the voltage dropped across the fluorescent lamp L, is obtained and connected to the monitoring circuit SENSE via the filter F. The lamp voltage signal can be either a voltage signal or a current signal. In the present exemplary embodiment, the input IN of the monitoring circuit SENSE is a current-sensitive input. The dependence of the input current of said input IN on the running voltage of the lamp L depends on the sum of the first resistor R1 and the third resistor R3 for DC signals. For AC signals, the dependence is lower according to the T-attenuation element comprising the first, second and third resistor, R1, R2, R3, wherein a limiting frequency for filter F can be set by means of the second resistor R2 and the filter capacitor C4.

The monitoring circuit SENSE is furthermore connected to the control circuit CTRL and supplies a monitoring signal to the controller CTRL in order, in the case where an operating disturbance has been ascertained, to cause the controller CTRL to effect an altered mode of operation and, in particular, the turn-off of operation with the fluorescent lamp L. Furthermore, the monitoring circuit SENSE receives a clock signal from the controller CTRL, which clock signal is dependent on the control of the transistors TR1, TR2 of the half-bridge and enables a conclusion to be drawn about the voltage UHB supplied by the half-bridge TR1, TR2. The two transistors TR1, TR2 are driven alternately in order to supply a rectangular or trapezoidal signal at the midpoint of the half-bridge. The clock signal of the controller CTRL can be a rectangular signal whose edges are in a fixed temporal relationship to the switching instants of the transistors TR1, TR2. For this purpose, the control signal can have either the same frequency as the voltage supplied by the half-bridge TR1, TR2, or else twice the frequency, such that in the latter case for each half-cycle irrespective of whether it is positive or negative, of the half-bridge TR1, TR2 an edge of identical polarity appears in the clock signal. Furthermore, the clock signal can be delayed or advanced with respect to the switching sequence of the transistors TR1, TR2 in order to obtain a temporal offset required for the specific evaluation task.

For the preheating of the fluorescent lamp L, the electrodes of the fluorescent lamp L can have heating coils each having two terminals. The preheating can be effected in a simple case by a resonance capacitor C5, as depicted by dashed lines, being connected to the free terminals of the heating coils that are not connected to the lamp voltage UL. In addition, however, there are also numerous other possibilities for energizing the heating coils for preheating the lamp L.

Figure 2:
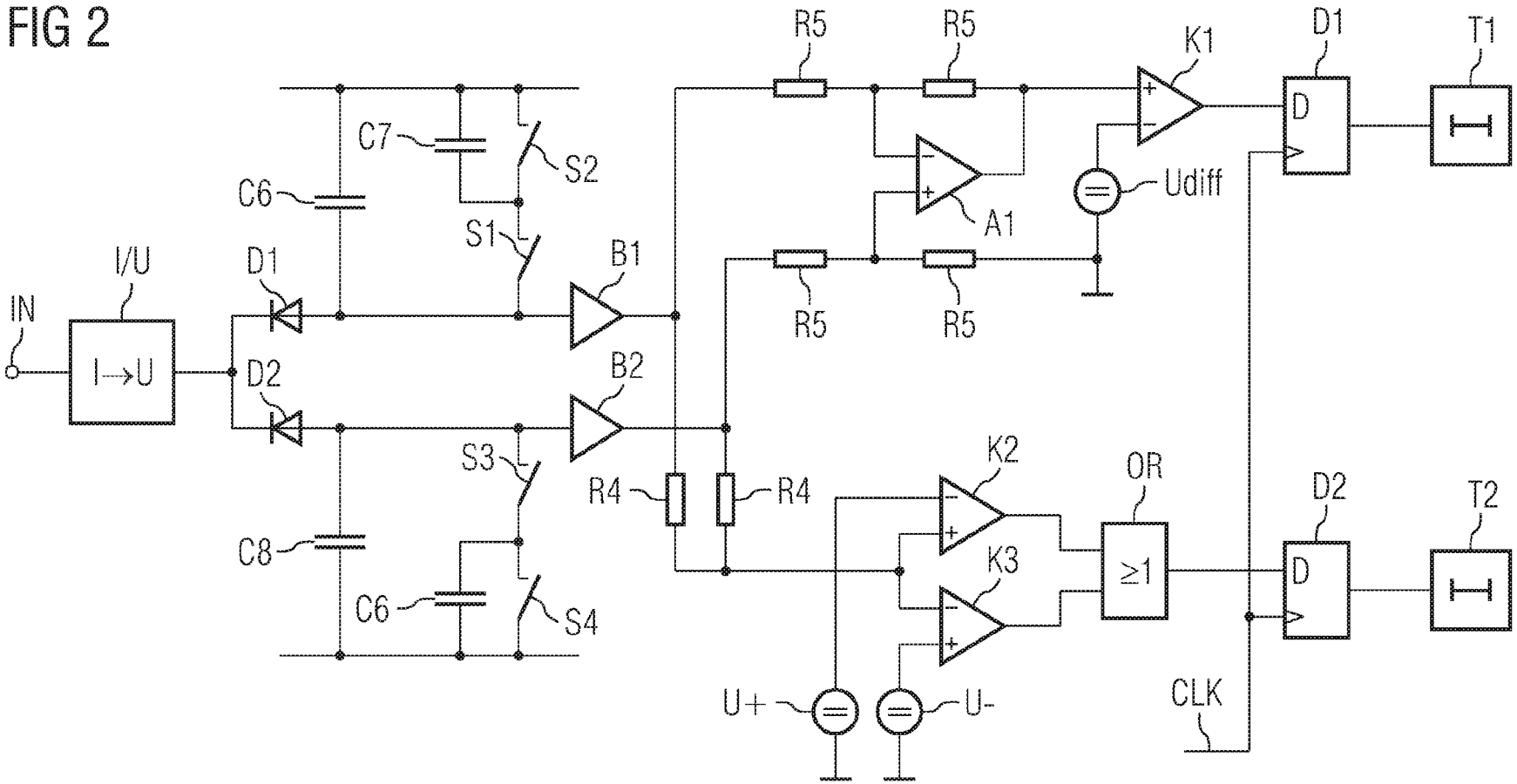
FIG. 2 shows the internal construction of an evaluation circuit for monitoring the operation of the fluorescent lamp for use in the circuit arrangement in accordance with FIG. 1.

FIG. 2 shows an exemplary embodiment of the monitoring circuit SENSE for use in the circuit arrangement in accordance with FIG. 1. The input IN illustrated on the left is connected to a current/voltage converter I/U, which supplies a voltage signal at its output depicted on the right. The output of the current/voltage converter I/U is followed by a positive and a negative peak rectifier, which are formed by two diodes D1, D2 with storage capacitors C6, C8 connected downstream. For this purpose, the cathode of the diode D1 of the negative peak rectifier is attached to the voltage output of the current-voltage converter I/U, the anode of said diode being connected to the negative storage capacitor C6 and to the input of a first buffer amplifier B1. The anode of the diode D1 thus forms the output of the negative peak value rectifier. A series circuit comprising a first switch S1 and a parallel connection of a second switch S2 with a negative discharge capacitance C7 is connected in parallel with the storage capacitance C6 of the negative peak rectifier. That terminal of the negative storage capacitance C6 which is not connected to the anode of the diode D1 is connected to a fixed reference potential, which can be for example a positive supply voltage within the monitoring circuit SENSE. Said fixed reference potential can also lie at any other point in the voltage range present in the monitoring circuit SENSE.

The positive peak value rectifier is constructed correspondingly, in which the anode of the second diode D2 is connected to the output of the current-voltage converter I/U. The cathode of the second diode D2 is connected to one terminal of the positive storage capacitance C8 and forms the output of the positive peak value rectifier which is connected to an input of a second buffer amplifier B2. A series circuit comprising a third switch S3 and a parallel connection of a fourth switch S4 with a positive discharge capacitance C9 is connected in parallel with the positive storage capacitance C8. That terminal of the positive storage capacitance C8 which is not connected to the cathode of the second diode D2 is connected to a fixed reference potential, which can be a negative supply voltage within the monitoring circuit SENSE in the present exemplary embodiment. However, said fixed voltage potential can also be any other voltage occurring in the monitoring circuit SENSE.

A sinusoidal signal having positive and negative half-cycles is essentially present at the input IN of the current-voltage converter I/U. Said half-cycles are converted into voltage signals by the current-voltage converter and fed to the peak value rectifiers, such that the positive storage capacitance C8 stores the maximum value of the positive half-cycle and the negative storage capacitance C6 stores the maximum value of the negative half-cycle. In order that the two peak value rectifiers can also follow decreasing maximum values of the half-cycles, the storage capacitances C6, C8 must be discharged from time to time, and in particular after each positive or negative half-cycle. For this purpose, the two discharge capacitances C7, C9 with the switches S1 to S4 connected thereto form discharge circuits that can partly discharge the storage capacitances C6, C8.

In the case of the negative peak value rectifier, this is done by virtue of the fact that the negative discharge capacitance C7 is discharged by the second switch S2 being closed, the second switch S2 is then opened and the negative discharge capacitance C7 is connected in parallel with the negative storage capacitance C6 by the first switch S1 being closed. As a result, a part of the charge stored in the negative storage capacitance C6 is recharged into the negative discharge capacitance C7 and the voltage at the negative storage capacitor C6 is thus reduced. That proportion of the charge stored in the storage capacitance C6 which is recharged into the discharge capacitance C7 depends on the capacitance ratio between the storage capacitance C6 and the discharge capacitance C7. If, by way of example, the discharge capacitance C7 has a tenth of the capacitance of the storage capacitance C6, an eleventh of the charge in the storage capacitance C6 is recharged, such that the charge in the storage capacitance C6 and hence also the voltage at the storage capacitance C6 are reduced to $^{10}/_{11}$ of the respective previous value since the voltage at a capacitance is proportional to charge contained therein. If generally the discharge capacitance C7 has the capacitance b and the storage capacitance C6 has the capacitance a, then a charge of one contained in the storage capacitance C6 prior to the recharging is discharged to a value a/(a+b) after the recharging. The same applies to the positive peak value rectifier with the storage capacitance C8 and the discharge capacitance C9.

The first buffer amplifier B1 supplies the negative peak value, which is the lowest voltage of the negative half-cycle, and the second buffer amplifier B2 supplies the peak value, which is the highest voltage of the positive half-cycle. The outputs of the two buffer amplifiers B1, B2 are connected via a series circuit of two average value resistors R4 both having the same resistance value. The midpoint of the series circuit of the average value resistors R4 thus supplies the arithmetic mean of the two peak values and thus a measure of the DC component in the lamp voltage signal.

This average value is supplied to a window comparator, which supplies a high signal if the average value is outside a specific voltage range, and supplies a low signal if the average value is within the voltage range. The window comparator is formed by a second comparator K2 and third comparator K3 in a manner known per se, the outputs of these two comparators K2, K3 being ORed by means of an OR element OR. The average value voltage between the two average value resistors R4 is conducted to the positive input of the second comparator K2 and the negative input of the third comparator K3. The negative input of the second comparator K2 is connected to the upper voltage threshold U+ and the positive input of the third comparator K3 is connected to the lower voltage threshold U-, such that one of the two comparators K2 or K3 supplies a high signal as soon as the average value is greater than the upper threshold voltage U+ or less than the lower threshold voltage U−.

The output signals of the two buffer amplifiers B1, B2 are furthermore fed to a differential amplifier formed by a first operational amplifier A1 together with four differential amplifier resistors R5, which are connected up in a known manner together with the first operational amplifier A1 to form a differential amplifier. The output of the first operational amplifier A1 forms the output of the differential amplifier and is connected to the positive input of a first comparator K1. The negative input of the first comparator K1 is connected to a voltage source Udiff, which prescribes a limit value for the difference between the two peak values, the difference between the peak values at the outputs of the two buffer amplifiers B1, B2 also being multiplied by a factor in the differential amplifier depending on the choice of differential amplifier resistors R5. As soon as the voltage difference between the two peak values at the outputs of the two buffer amplifiers B1, B2 is greater than the voltage threshold Udiff after amplification by the amplification factor in the differential amplifier, the output of the first comparator K1 goes to high.

The output of the OR element OR therefore supplies a high signal if the arithmetic mean of the two peak values is outside a specific voltage range. It is thus possible to detect a DC component in the lamp voltage signal, which occurs for example when a rectifier effect of the fluorescent lamp L has occurred and said lamp therefore exhibits wear.

The output of the second operational amplifier A2 goes to high if the difference between the peak values exceeds a specific amount, such that an excessively large alternating signal amplitude or excessively high peak-peak voltage of the alternating signal component of the lamp voltage signal can be detected, which occurs for example when glass breaks in the fluorescent lamp L and there is an increased voltage drop caused by this at the lamp L.

The output of the first comparator K1 is stored by means of a first storage element D1, which is clocked with a clock signal CLK. The output of the OR element OR is likewise stored by means of a second storage element D2, which is likewise clocked by the clock signal CLK. The two storage elements D1, D2 operate in such a way that upon a positive edge of the clock signal CLK, the level present at the respective input D is accepted into the storage element and is output at the output on the right. This stored value is overwritten only with the next positive edge of the clock signal CLK and changes only if a different signal is present at this instant at the respective input D. A timer element T1, T2 is connected to each storage element D1, D2, said timer element being formed in such a way that the output of the respective timer element T1, T2 goes from low to high only when a high signal is present at the input for a specific time duration. This has the effect that a high level at the output of a storage element D1, D2 is relayed to the output of the timer element T1, T2 respectively connected thereto only when the high signal is present for a specific time duration.

A time duration of the order of magnitude of 0.1 ms to 10 ms is set for the first timer element T1 at the output of the first storage element D1 for the purpose of monitoring a symmetrical rise in the running voltage. A time duration of the order of magnitude of 1 s to 10 s is set in the case of the timer element T2 at the output of the second storage element D1 for the purpose of detecting an asymmetrical running voltage or a DC component in the running voltage.

The output signals of the two timer elements T1, T2 lead to a turn-off of the half-bridge independently of one another. For this purpose, the output signals of the two timer elements T1, T2 are supplied directly or after an ORing from the monitoring circuit SENSE to the controller CTRL, where they lead to a turn-off of operation and hence of switching of the two transistors TR1, TR2 in the half-bridge.

Figure 3:
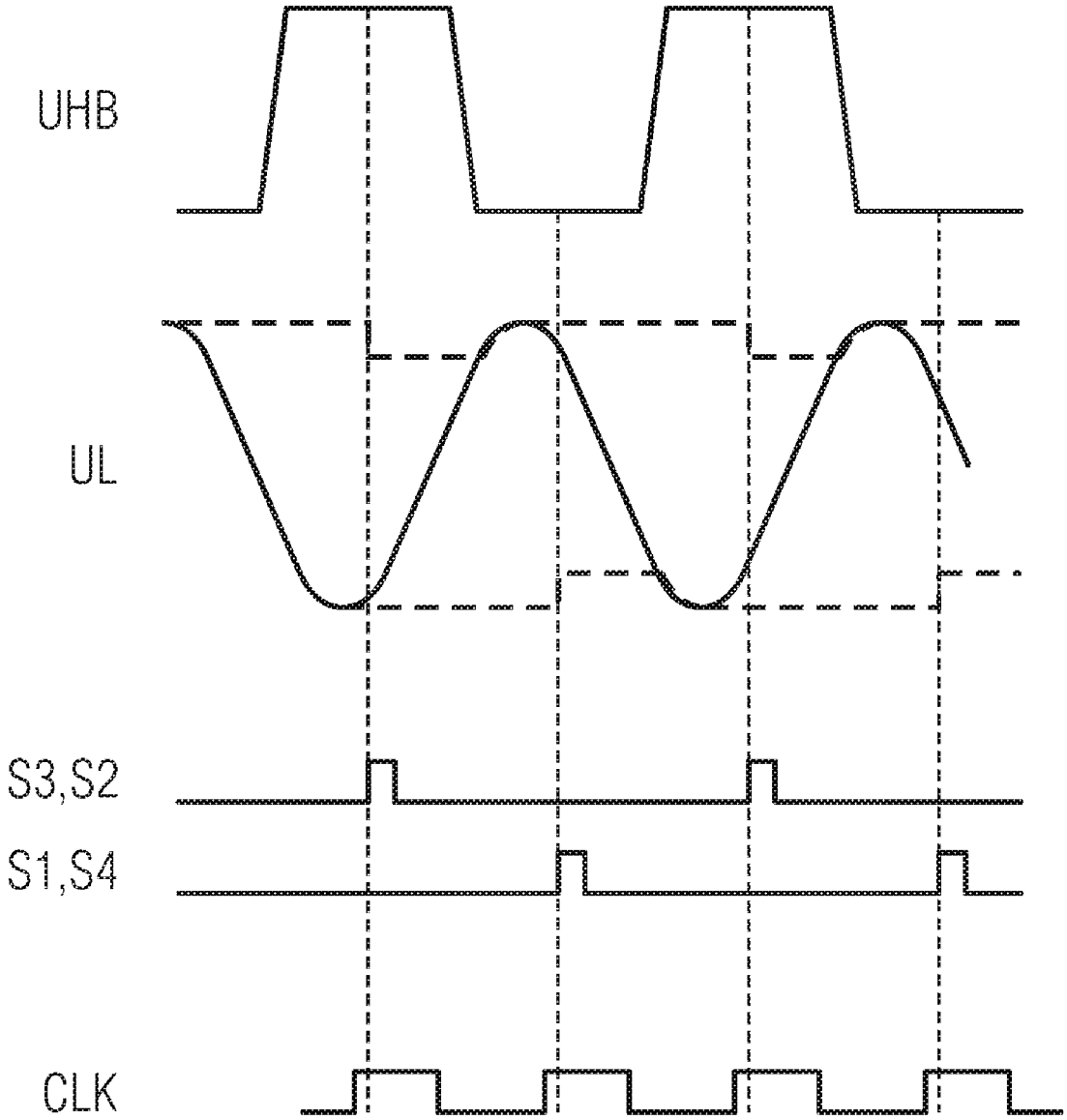
FIG. 3 shows the temporal profile of various signals occurring in the circuit arrangements in accordance with FIG. 1 and the evaluation circuit in accordance with FIG. 2.

FIG. 3 illustrates signal profiles by way of example. The output voltage UHB of the half-bridge TR1, TR2 is illustrated at the top. This signal is a trapezoidal rectangular signal, the inclined edges being caused by the capacitor C2 at the output of the half-bridge.

The lamp voltage UL is illustrated underneath, said lamp voltage being essentially sinusoidal. The lamp voltage UL lags with respect to the half-bridge voltage UHB, in principle, the phase difference being approximately 150° in the case shown.

The switching operations for the third switch S3 and the second switch S2 and respectively for the first switch S1 and the fourth switch S4 are illustrated underneath. A high signal in one of these two signal profiles means that the switch is closed, and a low signal means that the switch is open. The vertical dashed lines through all the signal profiles indicate in each case the temporal mid-point of the positive or negative half-cycle of the half-bridge voltage UHB. The switching operations of the switches S1 to S4 take place precisely at these instants in each case, as specified. The clock signal CLK is illustrated underneath, which has twice the frequency of the half-bridge voltage UHB and leads the latter, which can be seen from the fact that the positive edges of the clock signal CLK always occurs somewhat earlier than the centre—depicted by dashed lines—each half-cycle of the half-bridge voltage UHB. The clock signal CLK is used for driving the two storage elements D1, D2 and leads with respect to the switching operations of the switches S1 to S4 since, after a switching of the switches S1 to S4, the peak value rectifiers are already partly discharged and no longer have the correct value.

In general, by means of suitable choice of the instants at which the switches S1 and S3, respectively, are closed and at which the output signals of the second operational amplifier A2 and of the OR element OR are sampled by means of the storage elements D1, D2, respectively valid peak values, not yet discharged, of the storage capacitances C6, C8 can be evaluated even if the phase angle of the running voltage UL in relation to the half-bridge voltage UHB is not precisely known. By way of example, under any circumstances it is possible to achieve a correct evaluation within various angles of between 60° and 150° if the switches S1 and S3 are in each case closed in the middle of the switch-on durations of the half-bridge switches TR1, TR2.

Even though FIG. 1 illustrates a specific embodiment for the filter F, any other filter embodiments are conceivable in which a DC component is subjected to a different attenuation from an AC voltage component having the frequency of the lamp voltage. Besides simple RC filters, filters having at least one inductance are also conceivable. In principle, all known filters with a pole-zero pair can be used, in which case active filters can also be used. By way of example, the attenuation for the DC component may be lower than for the AC voltage component having the frequency of the lamp voltage. This can generally be achieved by means of a low-pass filter.

In the case of the circuit arrangement illustrated in FIG. 2, the gain of the current/voltage conversion U/I and the input current levels thereof should only be chosen with a magnitude such that the highest lamp running voltage UL to be expected at which the circuit is intended to still function in connection with the highest DC voltage shift to be expected can be represented by the modulation range of the current-voltage converter I/U. Said modulation range is essentially determined by the magnitude of the supply voltage and by the saturation voltage of the amplifier voltage. A supply voltage of the current-voltage converter I/U of 5 volts and saturation voltages of in each case 0.5 volt shall be assumed here by way of example, such that the modulation range is 4 Vpp.

In the extreme case fluorescent lamps can exhibit the failure pattern of a hard rectifier effect. The DC voltage shift corresponding to the DC component of the lamp voltage UL then assumes the same order of magnitude as the running voltage. With a planned reserve, the modulation range should therefore amount to 2.5-3 times the maximum running voltage. In the present example, it would be necessary to represent the maximum running voltage at approximately 1.5 Vpp at the output of the current-voltage converter I/U, which corresponds to an amplitude of 750 mV.

If it were desired to evaluate the DC component of the lamp voltage UL accurately to one percent of the maximum lamp voltage UL, then the further evaluation circuit would have to operate accurately to 7.5 mV in the present example. Errors arise for example also as a result of leakage currents of the switches S1 to S4 and of the diodes D1, D2. Given an assumed leakage current of 10 nA and a period duration of the oscillation of 25 μs, the two storage capacitances C6, C8 would accordingly have to be chosen each with a magnitude of 33 pF.

Figure 4:
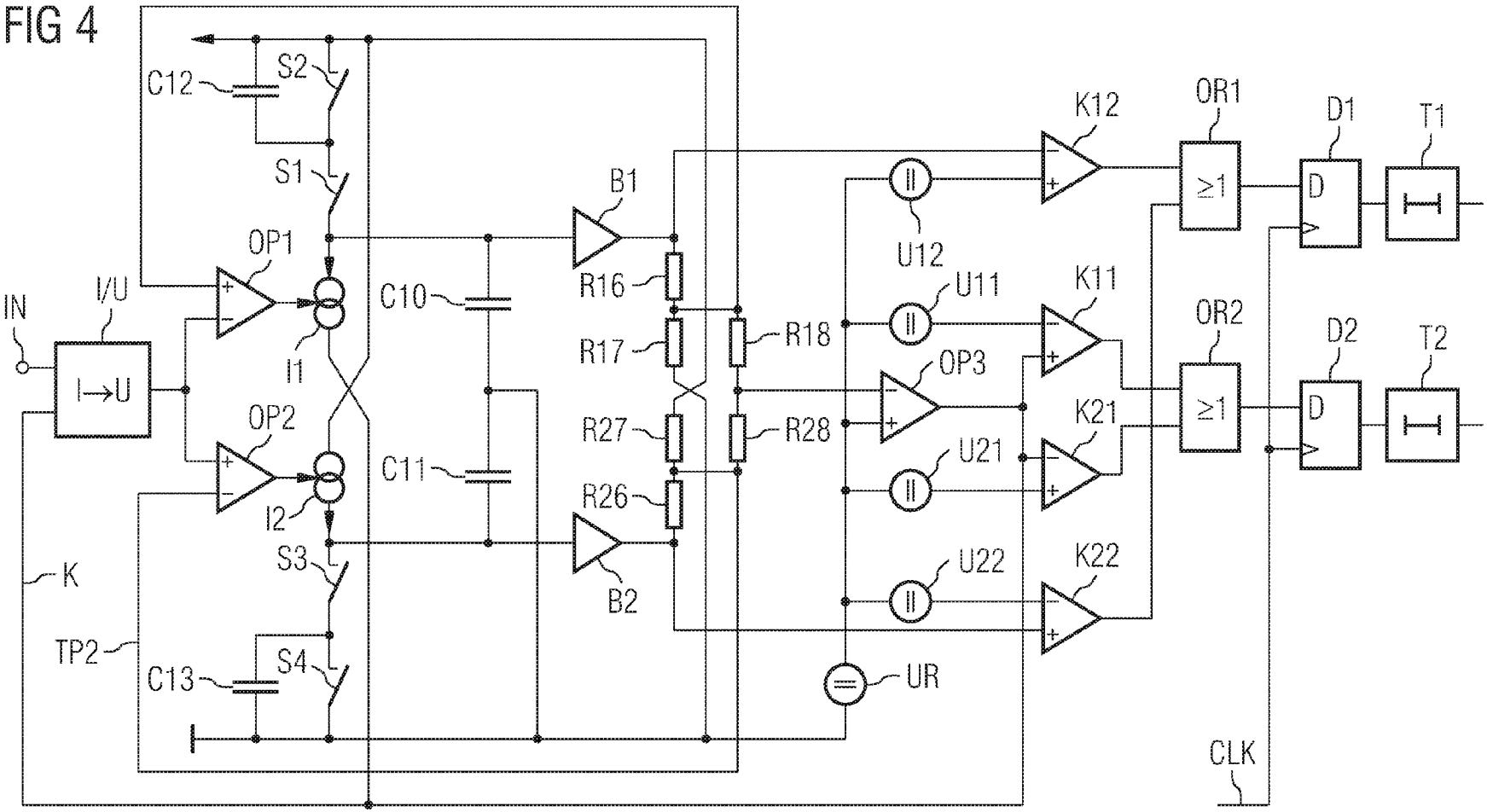
FIG. 4 shows the internal construction of the evaluation circuit for monitoring the operation of the fluorescent lamp in accordance with a second exemplary embodiment for use in a circuit arrangement in accordance with FIG. 1.

FIG. 4 shows a further exemplary embodiment of a monitoring circuit SENSE, to which a current signal at the output of the filter F is likewise fed via an input IN. In this circuit arrangement, the current-voltage converter I/U has an additional input for a signal K. The output signal of the current-voltage converter I/U is formed by current-voltage conversion of the input signal at the input IN and addition to the signal K.

The diodes D1, D2 of the circuit arrangement from FIG. 2 are in each case replaced by an OTA, which are formed from a first operational amplifier OP1 and a first current source I1 and, respectively, by a second operational amplifier OP2 and a second current source I2. The controllable current sources I1, I2 are in each case constructed in such a way that a current can flow only in the direction indicated by an arrow. Thus, a connected capacitance C10 can be charged only in a negative direction relative to the positive supply potential and a capacitance C11 can be charged only in a positive direction relative to the negative supply potential. The fact that the capacitances C10 and C11 are connected by their other end to the signal K rather than to a fixed potential is initially unimportant.

The voltages of the capacitors C11, C12, which form the storage capacitors for peak value determination, are in each case fed via a buffer amplifier as impedance converter B1, B2 to a resistor network R16 to R18 and R26 to R28, respectively. A respective output TP1, TP2 of the respective resistor network R16 to R18, R26 to R28 is fed back to an input of an OTA.

If, by way of example, the output voltage of the current-voltage converter I/U becomes higher than the common node TP2 between the resistors R26 to R28, then the second operational amplifier OP2 controls the second current source 12 in the conducting state, which thereupon charges the capacitance C11 positively relative to the negative supply potential. The voltage at the node TP2 common to the resistors R26 to R28 follows the charging operation in a divider ratio dependent on the resistance values. If it reaches or slightly exceeds the output voltage of the current-voltage converter I/U, the second operational amplifier OP2 controls the current source 12 in the non-conducting state again and the charging operation ends. If the output voltage of the current-voltage converter I/U changes, the charging operation can commence anew. The node TP2 common to the resistors R26 to R28 therefore assumes the positive peak value of the output voltage of the current-voltage converter I/U.

Conversely, the current sink I1 charges the capacitance C10 to a voltage that is negative relative to the positive supply potential until the node TP1 common to the resistors R16-R18 assumes the lowest peak value of the output voltage of the current-voltage converter I/U.

Since voltage changes at the storage capacitances C10, C11 appear only in attenuated fashion at the fed-back outputs TP1, TP2 of the resistor networks R16 to R18 and R26 to R28, the capacitor voltages can conversely change to a greater extent than the peak values of the output voltage of the current-voltage converter I/U. The resistance values should advantageously be chosen such that, without input current at IN, a voltage in the vicinity of the positive supply potential results at the input of the buffer amplifier B1 and a voltage in the vicinity of the negative supply potential results at the input of the buffer amplifier B2, and that furthermore in the case of maximum lamp voltage U1 without DC component with some reserve, a voltage in the vicinity of the negative supply potential results at the input of the buffer amplifier B1 and a voltage in the vicinity of the positive supply potential results at the input of the buffer amplifier B2.

The outputs TP1, TP2 of the resistor networks R16 to R18 and R26 to R28 are connected to one another via two identical resisters R18, R28. The common tap between the resistors R18, R28 is fed to a third operational amplifier OP3, the other input of which is connected to a reference voltage source UR.

The voltage of the reference voltage source UR serves as an average reference potential for the further evaluation circuit. The output of the third operational amplifier OP3 supplies the signal K inter alia also for the current-voltage converter I/U.

The circuit is co-ordinated overall such that in the case of an input signal IN without DC component, the output voltage of the third operational amplifier OP3 corresponds to the average reference potential UR and the output of the current-voltage converter I/U oscillates symmetrically around this potential. The voltage at the output TP1 of the network R16 to R18 is smaller than the average reference potential UR by the same magnitude as the voltage at the output TP2 of the network R26 to R28 is greater than the average reference potential UR.

If the lamp then ages until the positive and negative amplitudes of the running voltage UL differ, the output of the current-voltage converter I/U no longer oscillates symmetrically around the average reference potential. The voltage at the output TP1 of the network R16 to R18 relative to the average reference potential then differs in magnitude from the voltage at the output TP2 of the network R26 to R28 relative to the average reference potential. The differential voltage at the inputs of the third operational amplifier OP3 becomes not equal to zero and the output of the third operational amplifier OP3 changes.

At the same time, the input voltage K of the current-voltage converter I/U and with it the DC component of the output voltage of the current-voltage converter I/U also change. The control direction of the third operational amplifier OP3 is chosen such that the shift in the DC component of the output voltage of the current-voltage converter I/U that is caused by the output of the third operational amplifier OP3 counteracts the DC component of the lamp running voltage UL. In the settled state, the output of the current-voltage converter I/U will again oscillate symmetrically around the average reference potential, while the deviation of the output voltage of the third operational amplifier OP3 from the average reference potential represents a measure of the DC component of the lamp running voltage UL. The latter can be monitored in terms of magnitude in a simple manner by means of a window comparator K11, K21.

For stability reasons, the capacitances C10, C11 are connected to the output of the third operational amplifier OP3 and not to supply potentials, in order that the control loop also remains closed between the instants of the peak values.

The outputs of the buffer amplifiers B1, B2 contain information about the running voltage without DC component and can be evaluated by means of a differential amplifier and a comparator, as illustrated in FIG. 2.

In the case of the solution illustrated in FIG. 4, two comparators K12, K22 monitor the outputs of the buffer amplifiers B1, B2 individually with regard to a respective limit value prescribed by the voltage sources U12, U22. As long as the third operational amplifier OP3 succeeds in correcting the drift between the resistors R18 and R28 to the average reference potential, the two comparators K12 and K22 are redundant and will switch approximately at the same lamp running voltage UL. However, if the DC component at the input IN becomes so large that the output of the current-voltage converter I/U goes to limitation, then the third operational amplifier OP3 will no longer be able to correct the DC component because it likewise goes to limitation on the output side. Due to the lack of compensation, one of the outputs of the buffer amplifiers B1, B2 will assume such extreme voltage values that one of the comparators K12, K22 indicates an excessively high running voltage.

Even if the running voltage is actually not excessively high in terms of magnitude, the hard rectifier effect constitutes a hazardous state that should lead to turn-off with a short delay time, while a small asymmetry of the running voltage UL owing to the firing effect of brand-new lamps, can lead to turn-off only after a longer delay time.

The invention claimed is:

1. A method for monitoring the operation of a gas discharge lamp operated with an AC voltage, comprising:

filtering a lamp voltage signal dependent on a voltage drop across the gas discharge lamp with an attenuation that is different for a DC component and for a component having a frequency of the AC voltage;

determining a positive peak value and a negative peak value of the filtered lamp voltage signal;

determining an average value of the two peak values;

comparing the average value with a limit value;

determining difference value between the two peak values; and comparing the difference value to the limit value.

2. The method according to claim 1, wherein, in order to determine the two peak values, a positive storage capacitance is charged depending on a positive half-cycle of the lamp voltage signal and a negative storage capacitance is charged depending on a negative half-cycle of the lamp voltage signal.

3. The method according to claim 2, wherein the storage capacitances are partly discharged by temporary connection to at least one discharge capacitance.

4. The method according to claim 3, wherein the partial discharge of the storage capacitances is controlled by a controller that also controls the generation of the AC voltage.

5. The method according to claim 1, wherein the AC voltage for operating the gas discharge lamp is generated by a half-bridge connected to a DC voltage.

6. The method according to claim 1, wherein the average value of the two peak values is compared with an upper limit and a lower limit of a signal range and an alarm signal is generated if the average value is outside the signal range.

7. A monitoring device to monitor the operation of a gas discharge lamp from an AC voltage, comprising:

an input for receiving a lamp voltage signal that is dependent on a voltage drop across the gas discharge lamp, the lamp voltage signal being filtered with an attenuation that is different for a DC component and for a component having the frequency of the AC voltage;

a positive peak value rectifier to determine a positive peak value of the filtered lamp voltage signal;

a negative peak value rectifier, to determine a negative peak value of the filtered lamp voltage signal;

an average value comparator, to compare an average value of the two peak values with a limit value; and a difference value comparator to compare a difference value between the two peak values with the limit value.

8. The monitoring device according To one claim 7, further comprising two timer elements, each of the two timer elements to forward an evaluation signal only if the evaluation signal was active for a minimum time duration.

9. The monitoring device according to claims 7, wherein the monitoring device is part of a drive circuit for a gas discharge lamp and the drive circuit has a half-bridge circuit for generating an AC voltage to enable operation of the gas discharge lamp and a controller that controls the half-bridge circuit and stops an operation of the gas discharge lamp depending on an alarm signal supplied to the controller by the monitoring device.

10. The monitoring device according to claim 7, wherein the peak value rectifiers each include a storage capacitance and a discharge device.

11. The monitoring device according to claim 7, further comprising an average value storage element to store in clock-controlled fashion the result of the comparison of the average value of the two peak values and a difference value storage element to store in clock-controlled fashion the result of the comparison of the difference value between the two peak values.

* * * * *

UNITED STATES PATENT AND TRADEMARK OFFICE

CERTIFICATE OF CORRECTION

PATENT NO. : 7,812,612 B2
APPLICATION NO. : 11/863295
DATED : October 12, 2010
INVENTOR(S) : Feldtkeller et al.

It is certified that error appears in the above-identified patent and that said Letters Patent is hereby corrected as shown below:

On the Title page Item (73), please change the Assignee "Infineon Technologies AG (Neubiberg, DE)" to --Infineon Technologies Austria AG (Villach, AT)--

Signed and Sealed this
Fourteenth Day of June, 2011

David J. Kappos

David J. Kappos
*Director of the United States Patent and Trademark Office*